US005406359A

United States Patent [19]

Fletcher

[11] Patent Number: 5,406,359

[45] Date of Patent: Apr. 11, 1995

[54] ULTRA-HIGH EFFICIENCY INTERMEDIATE TRANSFER WITH PRE-TRANSFER TREATMENT ON AN IMAGING DRUM AND AN INTERMEDIATE BELT

[75] Inventor: Gerald M. Fletcher, Pittsford, N.Y.

[73] Assignee: Xerox Corporation, Stamford, Conn.

[21] Appl. No.: 125,730

[22] Filed: Sep. 24, 1993

[51] Int. Cl.[6] ..... G03G 15/01; G03G 15/14; G03G 15/16

[52] U.S. Cl. ..... 355/273; 118/645; 355/275; 355/326 R

[58] Field of Search ..... 355/271, 273–276, 355/326 R, 327; 118/645; 346/157

[56] References Cited

U.S. PATENT DOCUMENTS

| | | | |
|---|---|---|---|
| 4,162,843 | 7/1979 | Inoue et al. | 355/327 |
| 5,172,172 | 12/1992 | Amemiya et al. | 355/271 |
| 5,198,864 | 3/1993 | Fletcher | 355/274 |
| 5,204,716 | 4/1993 | Kasahara et al. | 355/274 X |
| 5,285,244 | 2/1994 | Bujese | 118/645 X |

FOREIGN PATENT DOCUMENTS

| | | | |
|---|---|---|---|
| 4-43375 | 2/1992 | Japan | 355/326 R |

*Primary Examiner*—William J. Royer
*Attorney, Agent, or Firm*—Oliff & Berridge

[57] ABSTRACT

An image forming apparatus forms a multi-colored image on an image receiving member. The image forming apparatus has a plurality of imaging devices, an image support device and a transferring device. Each imaging device has an imaging drum having a photoconductive layer, a charging device, an exposing device, developing device, a toner charging device and a transferring device. Each imaging device forms and transfers a charged toner image to the image support device. In another embodiment the image forming apparatus has a plurality of imaging devices, an image support device, a plurality of first charging devices and a transferring device. Each one of the plurality of imaging devices produces a toned image. The image support device receives the plurality of toned images from the plurality of imaging devices. The plurality of imaging devices are spaced along a first direction of the image support device. Each one of the first charging devices charges each of the toned images into a charged toned image on the image support device. Each one of the charging devices is located downstream from each of the imaging devices in the first direction. The plurality of charging toned images forms a multi-toned image. The transferring device transfers the multi-toned image on the image support device to the image receiving member.

30 Claims, 4 Drawing Sheets

ULTRA-HIGH EFFICIENCY INTERMEDIATE TRANSFER WITH PRE-TRANSFER TREATMENT ON AN IMAGING DRUM AND AN INTERMEDIATE BELT

BACKGROUND OF THE INVENTION

1. Field of the Invention

This invention relates generally to a system for printing a multi-toned image in electrostatographic printing apparatus, and more particularly concerns an apparatus for pre-treating developed toner on the photoreceptor before transferring it to an intermediate belt.

2. Description of Related Art

Generally, process electrostatic copying exposes an image of an original document onto a substantially uniformly charged photoreceptive member. The photoreceptor has a photoconductive layer. Exposing the charged photoreceptive member with the image discharges areas of the photoconductive layer corresponding to non-image areas of the original document, while maintaining the charge in image areas. Thus, a latent electrostatographic image of the original document is created on the photoconductive layer of the photoreceptive member. Charged developing material is subsequently deposited on the photoreceptive member. The developer material is either a liquid material or a powder material. The charged image areas on the photoconductive member attract the developer material to convert the latent electrostatic image into a visible image. The developer material is then transferred from the photoreceptive member, either directly or after an intermediate transfer step, to a copy sheet or other support substrate to create an image which is permanently affixed to the copy sheet. In a final step, any residual developer material is removed from the photoconductive surface of the photoreceptive member to prepare the photoreceptive member for a next imaging cycle.

This electrostatographic copying process is well known and is commonly used for light lens copying of an original document. Analogous processes also exist in other statographic printing applications such as, for example, ionographic printing and reproduction, where the charge is deposited on a charge retentive surface in response to electronically generated or stored images.

In multi-color electrostatographic printing, rather than forming a single latent image on the photoconductive surface, successive latent images corresponding to different colors are created. Each single-color latent electrostatic image is developed with a correspondingly colored toner. This process is repeated for a plurality of cycles. Each single-color toned image is superimposed over the previously transferred single-color toned image(s) when transferred to a copy sheet. This creates a multilayered toned image on the copy sheet. Thereafter, the multilayered toned image is permanently fixed to the copy sheet, creating a full-color copy.

In tandem color printing, to which the present invention relates, four imaging drum systems are generally used. Each imaging drum system separately charges the respective photoconductive drum, forms a latent electrostatic image on the respective drum, develops a toned image on the respective drum and then transfers the toned image to an intermediate belt. In this manner, yellow, magenta, cyan and black toned images are separately transferred to the intermediate transfer belt.

Generally, the toned images are separately transferred to the belt and superimposed on top of each other to form a four-layered toned image on the intermediate belt. When properly superimposed, these four toned images are capable of producing a wide variety of colors. Therefore, it is important to properly align and register the toned images on the belt. Each tone layer transferred to the intermediate belt is subjected to numerous electrostatic fields along the intermediate belt. Because of the electrostatic fields, the toned layers lose some of their charge, thereby decreasing the efficiency of the subsequent transfer to the copy sheet. It is therefore important to charge each toned layer to a sufficient level to enable efficient transfer to the copy sheet.

Additionally, in tandem color printing, the toner often splatters in pre-transfer zones of subsequent imaging systems. This occurs because the transferring device of each imaging system sometimes extends the transfer electrostatic field into the pre-transfer zone. A strongly charged toned image on the intermediate belt advantageously avoids toner splatter caused by any subsequent imaging systems.

SUMMARY OF THE INVENTION

This invention solves these problems. This invention charges the toned image on the photoreceptive drum to a specific corona charge level before transferring the toned image to an intermediate belt.

This invention also ensures that all of the toned image layers have the enhanced charge level in order to enable high transfer efficiency in the final transfer from the intermediate belt to the output copy paper.

This invention further provides corona treatment of the toned image on the intermediate belt prior to the pre-transfer gap of any subsequent imaging drum system to prevent gap transfer and toner splatter.

This invention thus comprises an apparatus producing multi-toned image, the image comprising a plurality of color layers on an image receiving member. The apparatus comprises: a plurality of imaging devices, an image support device for receiving toned images from the plurality of image devices, and a transferring device for transferring a multi-toned image on the image support device to an image receiving member. Each imaging device comprises: an imaging drum, a charging device to charge a photoconductive layer of the drum, an exposing device to form a latent electrostatic image on the photoconductive layer of the drum, a developing device to form a toned image from the latent image, a toner charging device to charge the toned image on the drum, and a transferring device to transfer the charged toned image from the imaging drum to the image support device.

In another embodiment of this invention, an apparatus produces a multi-toned image on a image receiving member, the image comprising a plurality of color layers. The apparatus comprises: an image support device receiving a plurality of toned images from a plurality of imaging devices spaced along a first direction of the image support device, a plurality of transferring devices each device transferring a toned image from the plurality of imaging devices, a plurality of charging devices charging the toned images on the image support device and a second transferring device transferring the multi-toned image from the image support device to the image receiving member.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
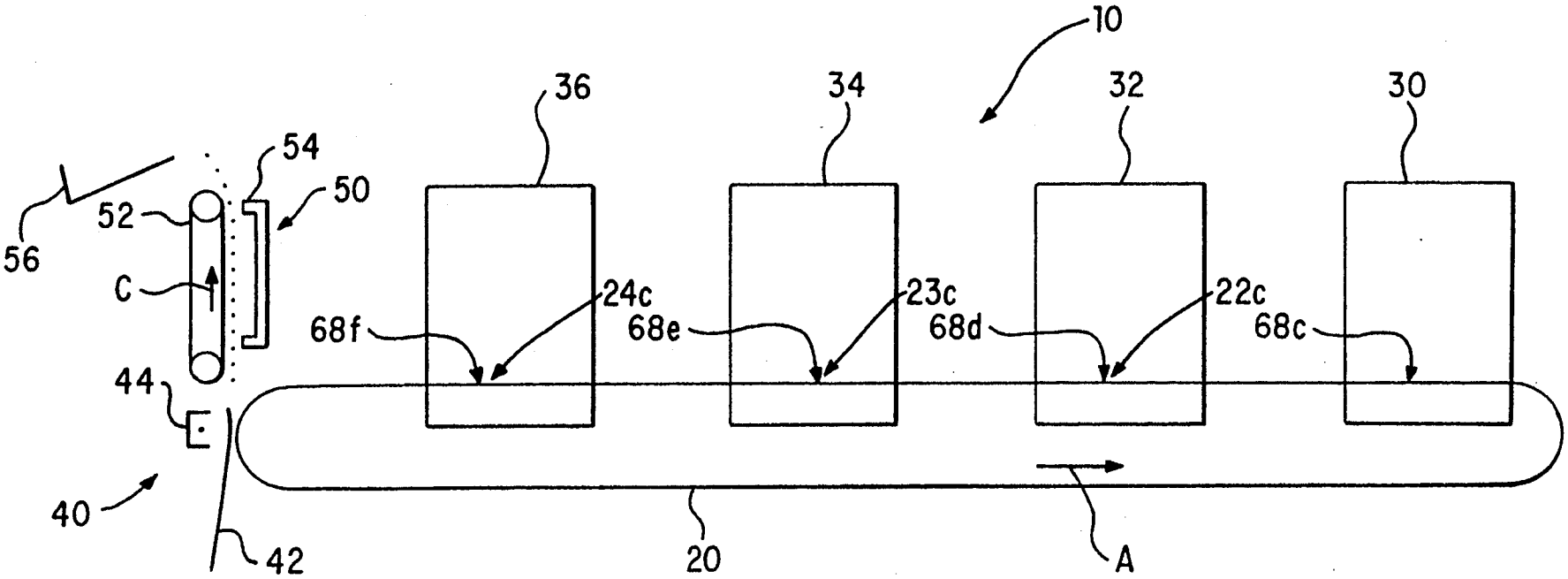
FIG. 1 is a schematic side view of a tandem printing engine using an intermediate belt and photoreceptive imaging drum systems.

In tandem color printing, four photoreceptive imaging drums separately form yellow, magenta, cyan and black toned images. These toned images are sequentially transferred to the intermediate belt 20 in proper registration with each other. FIG. 1 illustrates the operation of a tandem printing engine 10 incorporating the features of the preferred embodiment of the invention. Print engine 10 is an electrostatographic printing machine using an intermediate belt 20 as is well known in the art.

The intermediate belt 20 rotates in a direction marked by the arrow A. Timing detectors (not shown) sense the rotation of the intermediate belt 20 and communicate with machine logic circuits (not shown) to synchronize the various operations so that the proper sequence of events occurs in the printing process. Imaging station 30, shown in greater detail in FIG. 2, forms and transfers a toned image 68*c* to the intermediate belt 20. In the preferred embodiment, imaging station 30 transfers a yellow toned image 68*c*. The yellow toned image 68*c* rotates with the intermediate belt 20 to the transfer region of imaging station 32. The transfer region of each of the imaging stations is located between the imaging drum of the imaging station and the intermediate belt 20. In similar fashion, a second toned image is formed and transferred to the intermediate belt 20 by the second imaging station 32 in proper registration and alignment with the yellow toned image 68*c* already on the intermediate belt 20. The imaging station 32 transfers a magenta toned image 22*c* onto the yellow toned image 68*c* on the intermediate belt 20. Therefore, a yellow-magenta toned image 68*d* is produced in the transfer region of the imaging station 32. It is understood that the magenta toned image 22*c* is produced in a similar manner to the yellow toned image 68*c*.

The yellow-magenta toned image 68*d* on the intermediate belt 20 subsequently rotates with the intermediate belt 20 to the transfer region of the imaging station 34. The imaging station 34 transfers a cyan toned image 23*c* to the intermediate belt 20 in proper alignment and registration with the yellow-magenta toned image 68*d* already on the intermediate belt 20. This produces a cyan-yellow-magenta toned image 68*e*. In similar manner, the intermediate belt 20 rotates the cyan-yellow-magenta toned image 68*e* into the transfer region of the fourth imaging system 36, which forms and transfers a black toned image 24*c* to the intermediate belt 20. The black toned image 24*c* is superimposed on the cyan-yellow-magenta toned image 68*e* already on the intermediate belt 20. This produces a multi-layered toned image 68*f* comprising black, cyan, yellow and magenta.

Each toned image 68*c*, 22*c*, 23*c*, and 24*c* transferred to the intermediate belt 20 must be properly aligned and registered with the previous toned image(s) on the intermediate belt 20 so that the final multi-toned image 68*f* is a correct color copy. Such alignment and registration is controlled by a timing device (not shown) which controls the operations of the printing engine 10.

Not every document copied utilizes all four of the tandem colors. As such, each imaging system 30, 32, 34 and 36 is selectively used in each printing process as is well known in the art.

After all four tandem color images transfer to the intermediate belt 20 in a superimposed manner to form the multi-layered toned image 68*f*, the intermediate belt 20 continues rotating in the direction of arrow A to advance the multi-toned image 68*f* on the intermediate belt 20 to a transfer station 40. The transfer station 40 advances a copy sheet 42 synchronously with the multi-toned image 68*f* on the intermediate belt 20 to transfer the multi-toned image 68*f* to the output copy sheet 42. The transfer station 40 includes a corona generating device 44 which sprays ions on the back side of the copy sheet 42 to attract the toner particles from the intermediate belt 20 to the copy sheet 42. After the toner particles are transferred to the copy sheet 42, the copy sheet 42 advances on a conveyor 52 through a fusing station 50. The fusing station 50 generally includes a radiant heater 54 to heat the copy sheet 42 to a temperature sufficient to permanently fuse the toner particles to the copy sheet 42. The output copy sheet advances in a direction of arrow C to a catch tray 56 where the copy sheet 42 may be readily removed by a machine operator.

Figure 2:
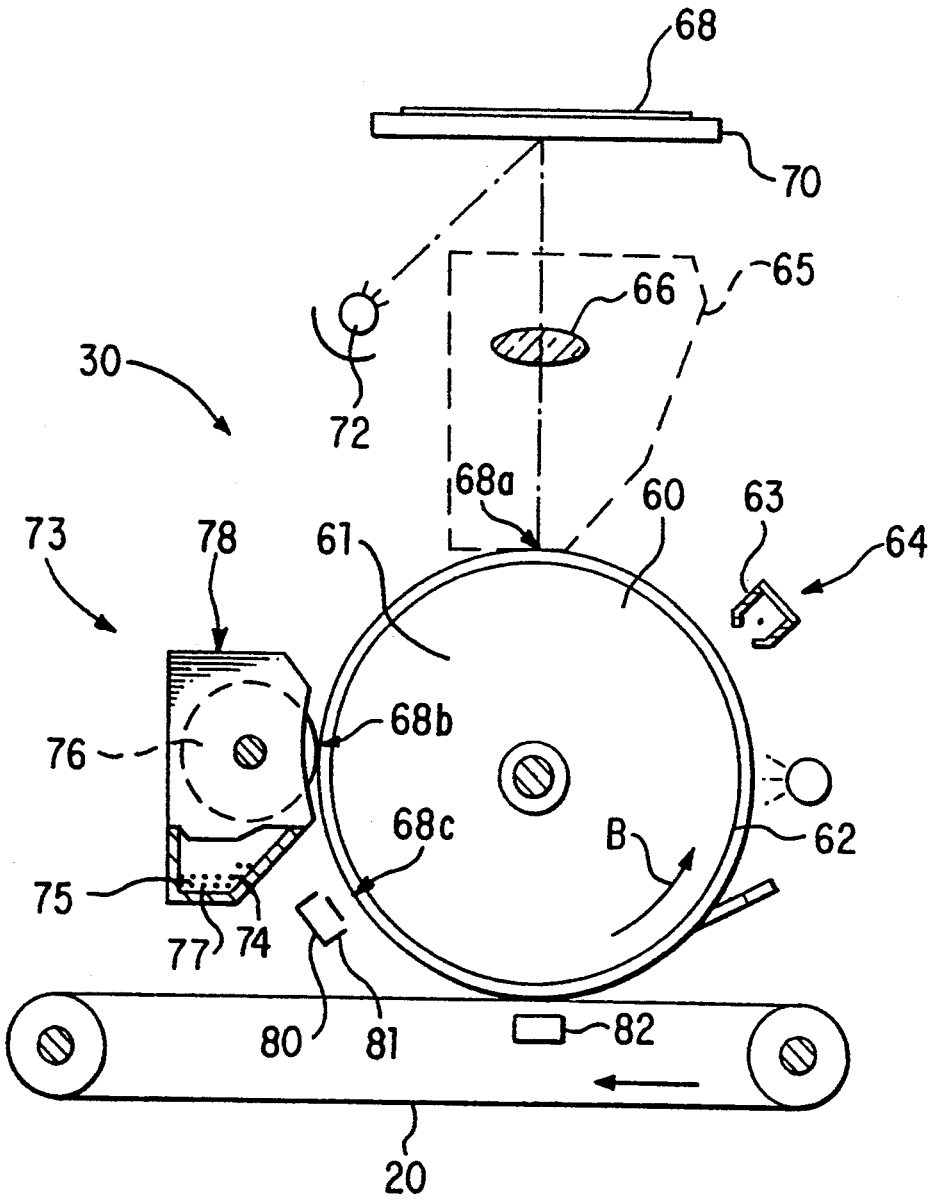
FIG. 2 is a schematic diagram of an electrostatographic printing machine incorporating the features of the preferred embodiment.

FIG. 2 shows one of the imaging stations 30, 32, 34 and 36 of FIG. 1. Although only one imaging station 30 is shown in FIG. 2, each of the other imaging stations 32, 34 and 36 operates in a similar manner, except that each imaging station produces a differently toned image 22*c*, 23*c* and 24*c*, respectively corresponding to the respective toner of the imaging station.

Figure 4:
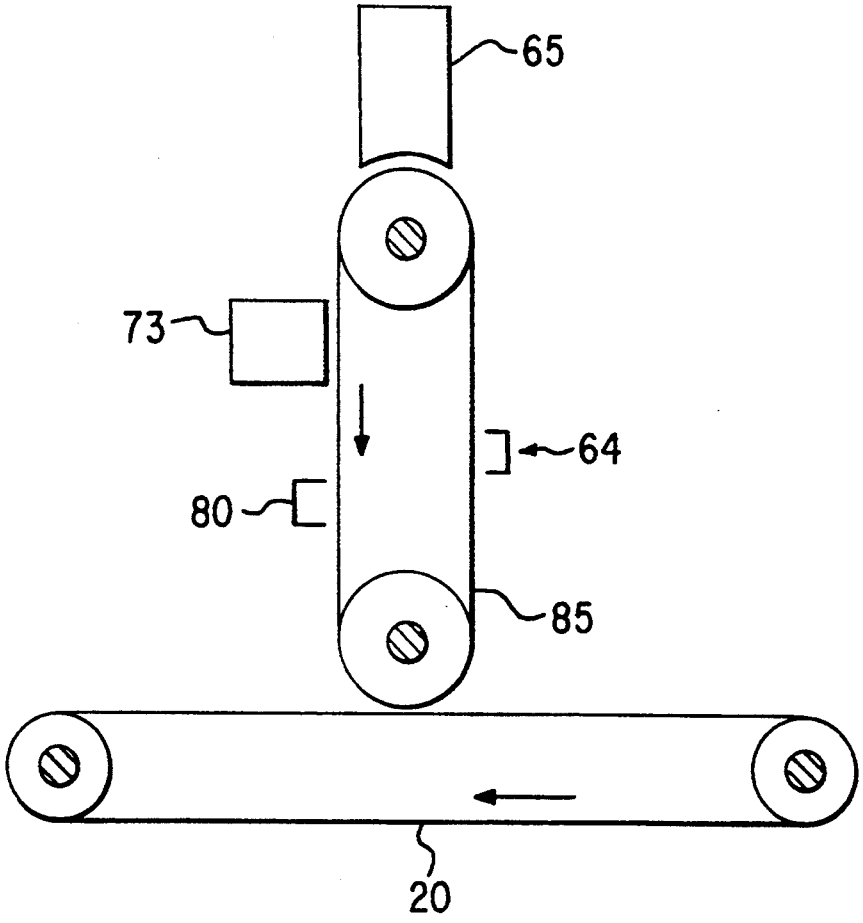
FIG. 4 is a schematic diagram of an electrostatic printing machine utilizing a photoconductive belt.

The electrophotographic imaging station 30 employs a drum 60 having a photoconductive layer 62 deposited on an electrically grounded conductive substrate 61. A series of processing stations for charging, exposing, developing, toner charging, transferring and cleaning are positioned about the imaging drum 60 so that as the drum 60 rotates in a direction of arrow B, it transports the surface of the photoconductive layer through each processing station. The imaging drum 60 is driven at a predetermined speed relative to the other machine operating mechanisms by a drive motor (not shown). Timing detectors (not shown) sense the rotation of the imaging drum 60 and communicate with the machine logic circuits (not shown) to synchronize the various operations of the imaging station 30 so that the proper sequence of events is produced at each of the processing stations. Although the embodiments will be described with respect to an imaging drum 60, other imaging devices can similarly be used such as a photoconductive belt 85 as shown in FIG. 4.

Initially, the imaging drum 60 rotates a portion of the photoconductive layer 62 through a charging station 64. At the charging station 64, a corona generating device 63 sprays ions onto the surface of the portion of the photoconductive layer 62 to produce a relatively high substantially uniform charge.

Once charged, the charged portion of the photoconductive layer 62 rotates to an exposure station 65 where a light image of an original document 68 is projected onto the charged surface of the photoconductive layer 62. The exposure station 65 includes a moving lens system 66. An original document 68 is positioned face down upon a generally planar, substantially transparent platen 70. Lamps 72 move in timed coordination with the lens 66 to incrementally scan successive portions of the original document 68. In this manner, a scanned light image of the original document 68 is projected onto the charged portion of the photoconductive layer 62 of the imaging drum 60. Each imaging station 30, 32, 34 and 36 in a tandem color printer receives a separate image corresponding to a respective color of the image as the original document 68 by using a detecting device (not shown). Each imaging station 30, 32, 34 and 36 forms a separate color image corresponding to images on the original document 68. This process selectively dissipates the charge on the photoconductive layer 62 to record an latent electrostatic image 68*a* corresponding to the informational areas on the original document 68 to the surface of the photoconductive layer 62. While the preceding description relates to a light lens system, one skilled in the art will appreciate that other devices, such as a modulated laser beam may be employed to selective discharge the charged portions of the photoconductive surface to record the electrostatic latent image.

After exposure, the imaging drum 60 rotates the latent electrostatic image 68*a* recorded on the surface of photoconductive layer 62 to a development station 73. The development station 73 deposits developer material 75 onto the latent electrostatic image 68*a* to form a visible toned image 68*b*. The developing station 73 includes a single developer roll 76 disposed in the developer housing 78. In the developer housing 78, toner particles 77 are mixed with carrier beads 79. This generates an electrostatic charge, causing the toner particles 77 to cling to the carrier beads 79 and form the developer material 75. Developer roll 76 rotates and attracts the developer material 75. As the magnetic roll 76 rotates, the developer material 75 is brought into contact with the surface of the photoconductive layer 62. The latent electrostatic image 68*a* on the surface of the photoconducting layer 62 attracts the toner particles 77 of the developer material 75 and develops the latent electrostatic image 68*a* into a visible toned image 68*b*. The toned image 68*b* includes a background region and a toner region corresponding to image areas on the original document 68.

The imaging drum 60 continues rotating to a pre-transfer toner charge station 80. At this toner charge station 80, a pre-transfer charge is applied to the drum 60 prior to the transfer region of the imaging drum 60 to form a charged toned image. In the embodiment described above, the charged toner image formed by the imaging station 30 is a yellow toned image 68*c*. The transfer region of the imaging drum 60 is formed at the point of contact between the surface of the photoconductive layer 62 of the imaging drum 60 and the intermediate belt 20.

A first preferred embodiment uses a negative DC scorotron 81 in the toner charge station 80. The negative DC scorotron 81 has a negative high potential on the coronode wire and a negative potential on the grid of the scorotron. The negative potential on the grid is more negative than the potential above the toner regions on the toned image 68*b*. This embodiment uses a grid potential between 50 and 300 volts more negative than the potential above the toner region on the toned image 68*b*. Although the imaging system will be described using negative toner, it is understood that positive toner may also be used. If a positive toner is used, then a positive DC scorotron with a positive coronode wire is used. Similarly, the grid potential is then charged 50 to 300 volts more positively than the toner region on the toned image 68*b*.

When a single polarity coronode wire is used, only a single charge polarity is available for the pre-transfer toner charge. This is acceptable especially when the development process maintains a low developed background region. A second preferred embodiment uses both a positive DC set of coronode wires followed by a negative DC set of coronode wires in the toner charge station 80. With two different polarities of DC coronodes, two polarities of ions are available. The grid potential of both sets of coronodes is the same. When negative toner is used in the system, the grid potential is selected to be approximately 50 to 300 volts more negative than the potential of the toner regions on the toned image 68*b* and approximately 0 to 200 volts more positive than the background regions of the toned image 68*b*. The background regions generally have a greater positive potential of 100 to 350 volts compared to the toner regions.

The second preferred embodiment maintains the desired negative charge above the toner regions and also positively charges the background regions. Positively charging the background region suppresses toner transfer in unwanted regions of the toned image 68*b*. If positive toner is used in the imaging system, all of the above relationships would reverse but have the same objective, which is to charge the toner regions more positively and to charge the background regions more negatively.

A third preferred embodiment uses an AC coronode potential in a scorotron to create both positive and negative ions. The AC coronode scorotron produces similar results to the positive DC set of coronode wires followed by a negative set of coronode wires. The AC coronode scorotron is advantageous because of its smaller physical size compared to the two DC coronodes of the second embodiment. However, an AC coronode scorotron system typically requires higher peak potentials than the two DC coronodes of the second embodiment. High peak potentials cause arcing problems in high process speed systems. Therefore, the two polarity DC coronode system of the second embodiment is preferred to the AC coronode scorotron embodiment when process speeds are greater than 10 in/sec.

The pre-transfer charging of the toned image 68*b* described above levels the background regions and image regions on the imaging drum 60 prior to rotation into the transfer station 82 of the imaging drum 60. Levelling is important in transfer systems that use conductive bias transfer rollers or other types of conductive biased devices such as conductive blades or conductive brushes. These devices create the electrostatic fields necessary to transfer the toned image 68*b* from the imaging drum 60 to the intermediate belt 20. The potential above the imaging drum 60 behaves substantially identical but in opposite polarity to the applied potential on the biased device in the transfer region. For example, a potential of −400 volts above the toner region of the toned image 68b has substantially the same effect on the electrostatic fields in the transfer region as a +400 volt potential on a conductive biased roller in contact with the intermediate belt 20 in the transfer region. Since the applied potential for transfer to the intermediate belt 20 can be as low as 600 volts, the potential above the imaging drum 60 has a large influence on the electrostatic fields. Without pre-transfer treatment, the potentials above the background regions, and the solid toner regions of a toned image 68b can be significantly different. This difference causes higher applied fields in the background regions compared to the high density solid toner regions.

The different applied fields of the background and toner regions negatively affects the transfer efficiency, especially in intermediate transfer systems. For example, if the applied fields in the transfer region are too low, an overall low quality transfer occurs because the applied electrostatic forces do not overcome the adhesive forces that hold the toner to the imaging drum 60. However, if the applied fields are too high, the transfer efficiency lessens and the quality degrades. The quality loss associated with high applied electrostatic fields is caused by the air breakdown near and within portions of the toner pile causing polarity charge reversal of some of the toner and loss of transfer efficiency.

The charged yellow toned image 68c on the imaging drum 60 subsequently rotates to a transfer station 82. At the transfer station 82, the charged yellow toned image 68c electrostatically transfers to the intermediate belt 20. Transferring toned images between a drum 60 and an intermediate belt 20 is accomplished by electrostatographic induction using a corotron or other field generating device such as a bias transfer roller as explained above. In corona-induced transfer systems, the intermediate belt 20 is placed in direct contact with the toned image while the toned image is supported on the drum 60. By spraying the back of the intermediate belt 20 with an opposite-polarity corona discharge, the toned image on the drum 60 transfers to the intermediate belt 20. Alternately, applying a potential difference between the conductive substrate 61 of the drum 60 and the intermediate belt 20 produces a electrostatic field to transfer the toned image. A biased transfer roller is preferred to corona-induced transfer because bias transfer rollers allow the application of mechanical pressure. Mechanical pressure during transfer is especially important to reduce air gaps in the transfer region. Typically, corona-induced transfer systems allow larger air gaps in the transfer region because of the marginal contact pressure. This causes poor transfer efficiency. Such marginal contact pressure causes larger air gaps near the toned image. The applied fields are limited to smaller levels when the air gaps are larger due to the well known Paschen effect.

In color intermediate transfer systems, some of the colored toner previously transferred to the intermediate belt 20 by an imaging drum 60 can transfer from the belt 20 to any subsequent imaging drum 60 used to create subsequent color toned images. This problem is called back transfer. Studies have shown that back transfer occurs when the applied fields used to transfer the toned images are too high. Again, this is caused by the air breakdown reversal of some of the toner charge. By increasing the charge of the toner regions by pretransfer treatment, the loss of transfer efficiency at high electrostatic fields is reduced.

Pre-transfer treatment advantageously levels the imaging drum 60 potentials between background regions and toner regions. This helps reduce back transfer problems. For example, upon transfer to the belt 20, a yellow-toned image 68c rotates to a subsequent imaging drum 60 that forms and transfers a magenta-toned image 22c onto the belt 20. In image regions where only yellow toner is needed, magenta toner will not be needed. If pre-transfer levelling of the magenta imaging drum 60 is not used, the applied fields above the yellow toner image region on the belt 20 will be higher than the applied transfer fields of the magenta-toned image 22c. At high fields desired in magenta-toned image regions to achieve high transfer efficiency, the fields in the yellow-toned image region can then be so high as to cause back transfer of the yellow toner to the magenta imaging drum 60 in the magenta background regions. Levelling the magenta imaging drum 60 potential by pre-transfer toner charge helps reduce this problem. Similarly, pre-transfer levelling of the previous yellow imaging drum 60 potentials and any subsequent imaging drum 60 potentials also helps reduce back transfer problems.

In an intermediate belt transfer system, similar problems occur due to different charge buildup levels on the intermediate belt 20 as it rotates through the various transfer regions of the imaging stations 30, 32, 34, and 36. The charge transferred to the intermediate belt 20 from previous imaging stations affects the electrostatic fields in the subsequent transfer regions of imaging stations. Typically, the charge transferred to the belt 20 significantly differs between toner regions and background regions. Additionally, the toner region charge differs significantly on a belt 20 having two or three different color toner layers compared to a toned image having only one color toner layer. The corresponding potentials of the toner regions and the background regions on the intermediate belt 20 can differ by as much as 800 volts.

For bias transfer intermediate systems, the deposited charge potentials on the belt 20 behave substantially similar to the applied potential on the drum substrate 61. These potentials can be compensated in subsequent imaging drum transfer regions by changing the applied potential on the bias transfer rollers used in the subsequent transfer region by the amount of potential on the intermediate belt surface. However, this can only be done as an average if different intermediate belt potentials are present in different regions. Therefore, different intermediate belt regions have different levels of applied fields, depending on the toned image and on the previous imaging drum setpoints, unless some levelling of the intermediate belt potential is done. These different fields cause poor transfer because of too low an applied field in some regions and too high an applied field in other regions. The latter causes back transfer problems.

Figure 3:
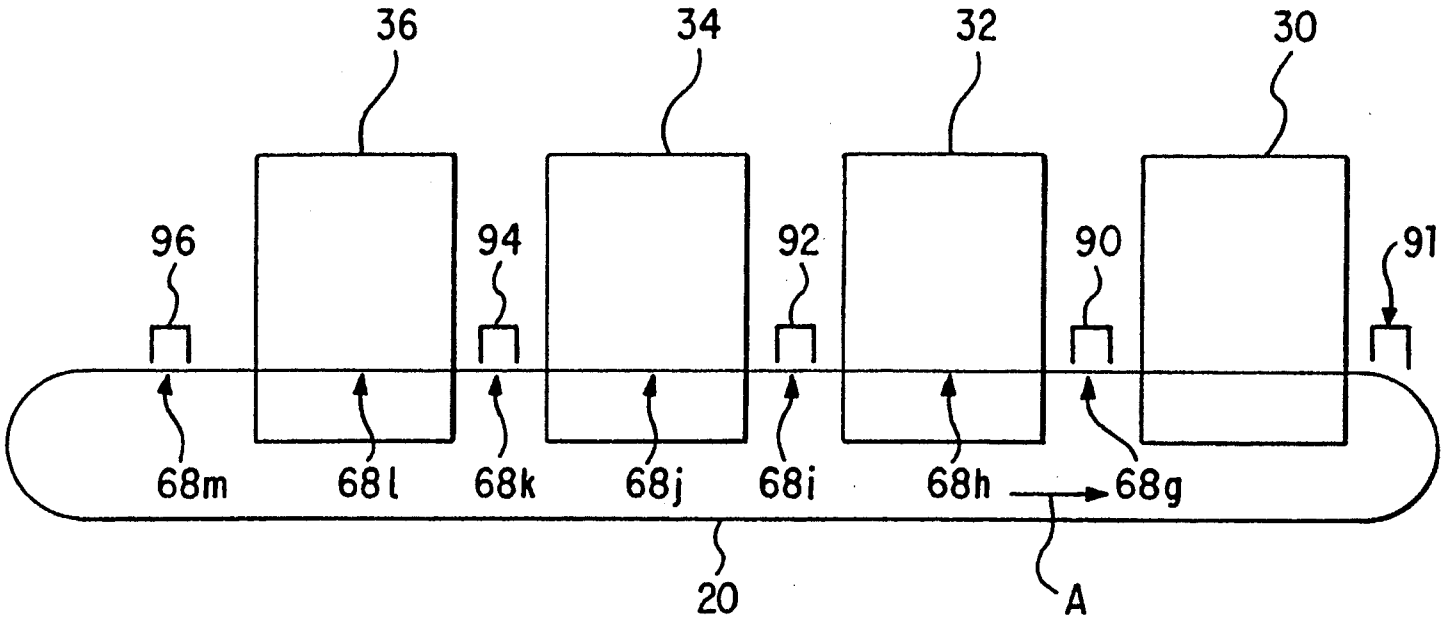
FIG. 3 is a schematic side view of a tandem printing engine incorporating the features of another preferred embodiment of the invention.

In order to solve these problems in intermediate belt transfer systems, similar toner charging embodiments as described above are used along the belt 20. The scorotron treatment on the intermediate belt 20 between each of the imaging drums 60 levels the intermediate belt 20 potentials in the various toned regions to avoid back transfer and poor transfer problems. It is beneficial to use scorotron treatment before and after each imaging drum 60 along the intermediate belt 20. However, it is primarily important to use scorotron treatment prior to the first imaging drum 60 and between the second and third imaging drums 60. For scorotron treatment prior to the first imaging drum 60, the intermediate belt 20 potential will invariably be both positive and negative due to effects caused by the cleaning system (not shown) or other subsystems acting on the belt 20 during rotation. Therefore, as shown in FIG. 3, an AC scorotron or preferably a two polarity coronode DC scorotron 91 described above are typically used rather than simple DC scorotron. FIG. 3 shows four imaging systems 30, 32, 34 and 36. Each of the imaging systems is responsible for forming a different toned image 68*c* on the intermediate belt 30. As explained above, each of the toned images 68*c* is one of cyan, yellow, magenta and black. For example, FIG. 3 shows the first imaging station 30 producing a yellow toned image, the second imaging station 32 producing a magenta toned image, the third imaging station 34 producing a cyan toned image and the fourth imaging station 36 producing a black toned image. In accordance with this embodiment, a plurality of scorotrons 90, 92, 94 and 96 are respectfully provided downstream from each of the imaging stations 30, 32, 34 and 36. Therefore, the yellow toned image 68*c* on the belt 20 rotates under the scorotron 90 where it is charged to form a charged yellow toned image 68*g*. In similar manner, the toned image 68*h* (representing a yellow-magenta toned image) is charged by scorotron 92 to form the charged toned image 68*i*. Still further, the charged toned image 68*k* is formed after the toned image 68*j* (representing a cyan-yellow-magenta toned image) rotates under the scorotron 94. Finally, the charged toned image 68*m* is formed by rotating the toned image 68*l* (representing a black-cyan-yellow-magenta toned image) under scorotron 96.

Toner charge treatment also benefits the subsequent transfer of the toned image from the intermediate belt 20 to the copy sheet 42. During the transfer process from the drum 60 to the intermediate belt 20, some toner charge reduction and reversal invariably occurs by the air breakdown. Toner charge treatment on the imaging drums 60 and between the imaging stations helps enhance transfer to the copy sheet 42 by preventing the reversal of toner charge. However, the toner charge in the three-color-black toner regions can be very high after the toner charge treatments described above even if the toner charge in single color separation regions of the document contains some reversed charge toner. Very high toner charge with a high toner mass per unit area found in a three-color-black toned image typically requires very high applied fields for high efficiency transfer to the copy sheet 42. However, the lower mass per area image regions corresponding to a single color typically will have poorer transfer efficiency and print quality if transferred to the copy sheet 42 at the high applied fields needed for the three-color-black toned images.

To relieve this problem, a selective charging corona treatment after the fourth color separation drum is used in one embodiment to reduce the net charge on the three-color-black toned image and yet still enhance the toner charge in the single color image regions. In this embodiment, an AC scorotron or else preferably a double coronode polarity DC scorotron is used. In practice it is invariably found that, for example with negative toner, the potential above the three-color-black toned image after the fourth imaging drum is much more negative than the potential in the single color document regions. Typical differences are above 400 volts. The potential of the scorotron grid is then chosen to be more negative than the intermediate belt 20 potential in the single color layer region but more positive than the potential in the three-color-black toned images. This tends to reduce the net toner charge in the three-color-black toned image but enhance the toner charge in the single color layer toned image. As in all previous embodiments, the potential of the intermediate belt 20 is also levelled between the various regions on the document and this adds the previously discussed advantages for the subsequent transfer to the copy sheet 42.

In color transfer from the intermediate belt 20 to the copy sheet 42, very high fields are typically required for high efficiency transfer. Intimate contact is critical to avoid large (>15 microns) air gaps in the toner pile is critical. In corona-induced transfer and especially in the preferred bias transfer roll approach, the fields produced are affected by the potential of the intermediate belt 20, as described above. Therefore, scorotron treatment to level the potentials on the intermediate belt 20 is especially important for the preferred bias transfer systems.

While the present invention has been described with reference to a preferred embodiment, it is understood that this invention is not limited to the preferred embodiment. On the contrary, it is intended that the present invention cover all alternatives, modifications and equivalents as may be included within the spirit and scope of the invention as defined by the appended claims.

What is claimed is:

1. An image forming apparatus forming a multi-colored image of a multi-colored original image on an image receiving member, the multi-colored image comprising a plurality of color layers, the image forming apparatus comprising:

a plurality of imaging devices, each imaging device comprising:

an imaging drum having a photoconductive layer, charging means for charging the photoconductive layer on said drum, exposing means for forming a latent electrostatic image on the charged photoconductive layer of said drum, developing means for developing the latent electrostatic image into a toned image, wherein each toned image is a different one of the plurality of color layers, first toner charging means for charging said toned image into a charged toned image on the imaging drum, and first transferring means for transferring the charged toned image on the drum to an image support means;

image support means for receiving each one of the charged toned images from said plurality of imaging devices, the plurality of charged toned images forming the multi-colored image; and second transferring means for transferring the multi-colored image on the image support means to the image receiving member.

2. The image forming apparatus of claim 1, wherein said first toner charging means is a DC scorotron.

3. The image forming apparatus of claim 1, wherein said first toner charging means comprises a positive DC set of coronode wires and a negative DC set of coronode wires.

4. The image forming apparatus of claim 1, wherein said first toner charging means is an AC scorotron.

5. The image forming apparatus of claim 1, wherein said first toner charging means is a corotron.

6. The image forming apparatus of claim 1, wherein said image support means is an intermediate belt.

7. The image forming apparatus of claim 1, wherein said second transferring means is a corotron.

8. The image forming apparatus of claim 1, wherein said first transferring means is a bias transfer device.

9. The image forming apparatus of claim 1, wherein said first transferring means is a corotron.

10. The image forming apparatus of claim 1, wherein the plurality of color layers comprises black, cyan, magenta and yellow.

11. An image forming apparatus forming a multi-colored image of a multi-colored original image on an image receiving member, the multi-colored image comprising a plurality of color layers, the image forming apparatus comprising:

a plurality of imaging devices, each capable of producing a toned image, wherein each toned image is one of the plurality of color layers;

image support means for receiving the plurality of toned images from the plurality of imaging devices, each toned image being one of the plurality of color layers, the plurality of imaging devices spaced along a first direction of the image support means;

a plurality of first charging means for charging each toned image into a charged toned image on the image support means, each one of the plurality of first charging means located downstream from a respective one of the plurality of imaging devices in the first direction, the plurality of charged toned images forming the multi-colored image; and transferring means for transferring the multi-colored image on the image support means to the image receiving member.

12. The image forming apparatus of claim 11, wherein each of said plurality of first charging means is an AC scorotron.

13. The image forming apparatus of claim 11, wherein each of the plurality of first charging means is a two polarity coronode DC scorotron.

14. The image forming apparatus of claim 11, wherein said transferring means is a corotron.

15. The image forming apparatus of claim 11, wherein said transferring means is a bias transfer device.

16. The image forming apparatus of claim 11, wherein said plurality of color layers comprises black, cyan, magenta and yellow.

17. The image forming apparatus of claim 11, wherein said image support means is an intermediate belt.

18. The image forming apparatus of claim 11, wherein said image forming apparatus further comprises a toner charging device located upstream from a first one of the imaging devices along the first direction of the image support means.

19. The image forming apparatus of claim 18, wherein said toner charging device is a AC scorotron.

20. The image forming apparatus of claim 18, wherein said toner charging device is a two polarity coronode DC scorotron.

21. The image forming apparatus of claim 18, wherein each one of the plurality of imaging devices comprises:

a photoconductive member;

an image charging device;

an exposing device;

a developing device; and an image transferring device.

22. The image forming apparatus of claim 21, wherein the photoconductive member is a drum.

23. The image forming apparatus of claim 21, wherein the photoconductive member is a belt.

24. The image forming apparatus of claim 21, wherein the image charging device is a corotron.

25. The image forming apparatus of claim 21, wherein the image transferring device is a corotron.

26. The image forming apparatus of claim 21, wherein the image transferring device is a bias transfer device.

27. The image forming apparatus of claim 21, further comprising a toner charging device.

28. The image forming apparatus of claim 27, wherein said toner charging device is a DC scorotron.

29. The image forming apparatus of claim 27, wherein said toner charging device comprises a positive DC set of coronode wires and a negative DC set of coronode wires.

30. The image forming apparatus of claim 27, wherein said toner charging device is a AC scorotron.

* * * * *